US006688291B2

(12) United States Patent
Onishi et al.

(10) Patent No.: US 6,688,291 B2
(45) Date of Patent: Feb. 10, 2004

(54) HIGH-PRESSURE FUEL SUPPLY SYSTEM

(75) Inventors: Yoshihiko Onishi, Tokyo (JP); Shigenobu Tochiyama, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/292,586

(22) Filed: Nov. 13, 2002

(65) Prior Publication Data

US 2003/0217736 A1 Nov. 27, 2003

(30) Foreign Application Priority Data

May 22, 2002 (JP) ..... 2002-147648

(51) Int. Cl.[7] ..... F02M 37/04
(52) U.S. Cl. ..... 123/506; 123/458
(58) Field of Search ..... 123/506, 458, 123/449, 514, 299, 300, 470, 509

(56) References Cited

U.S. PATENT DOCUMENTS 4,782,803 A * 11/1988 Kikuchi ..... 123/506
4,838,233 A * 6/1989 Hayashi ..... 123/506
5,205,262 A * 4/1993 Anton ..... 123/506
6,079,388 A * 6/2000 Nicol ..... 123/299
6,345,608 B1 * 2/2002 Rebold ..... 123/506
6,408,824 B1 * 6/2002 Pacucci ..... 123/467
6,546,918 B2 * 4/2003 Onishi ..... 123/506

FOREIGN PATENT DOCUMENTS

JP 2001-295719 10/2001

* cited by examiner

*Primary Examiner*—Carl S. Miller
(74) *Attorney, Agent, or Firm*—Sughrue Mion, PLLC

(57) ABSTRACT

A high-pressure fuel supply system can reduce the generation of noise upon opening and closing of an electromagnetic valve. The electromagnetic valve (100) of the high-pressure fuel supply system includes a body (41), a plunger (40) slidably received in the body (41), a valve seat (42) with which an end of the plunger is caused to move into and out of contact so that the valve seat is placed into fluid communication with a fuel pressurization chamber (27) when the plunger is moved apart from the valve seat, a stopper (43) for limiting the distance of separation of the plunger from the valve seat, and a spring (48) for urging the plunger in a direction toward the valve seat. An elastic O ring (101) is provided around the valve seat for absorbing collision sounds generated when the plunger collides with the valve seat.

5 Claims, 7 Drawing Sheets

HIGH-PRESSURE FUEL SUPPLY SYSTEM

BACKGROUND OF THE INVENTION

1. Field of the Invention

The present invention relates to a high-pressure fuel supply system used, for example, for a direct injection type internal combustion engine, and more particularly, it relates to a high-pressure fuel supply system including an electromagnetic valve arranged on a relief passage and controlled to be opened for a prescribed period on the discharge stroke of a fuel pump for controlling the amount of fuel discharged therefrom.

2. Description of the Related Art

FIG. 3 is a circuit diagram including a high-pressure fuel supply system 1.

This high-pressure fuel supply system 1 includes a low-pressure damper 3 arranged on a low-pressure fuel suction passage 2 for absorbing the pulsation of a low-pressure fuel, a high-pressure fuel pump 5 for pressurizing the low-pressure fuel from a low-pressure damper 3 to discharge it to a high-pressure fuel discharge passage 4, a relief passage 6 connecting between a suction side of the high-pressure fuel pump 5 and a pressurization chamber, and an electromagnetic valve 7 arranged on the relief passage 6 and being operated to open for adjusting the amount of fuel discharged from the high-pressure fuel pump 5. The high-pressure fuel pump 5 has a suction valve 8 and a discharge valve 9.

In the neighborhood of the high-pressure fuel supply system 1, there are provided a fuel tank 10, a low-pressure fuel pump 11 arranged in the fuel tank 10, a low-pressure regulator 12 arranged on the low-pressure fuel suction passage 2 for regulating the low-pressure fuel at a constant pressure, a relief valve 15 arranged on a drain pipe 14 branched from the high-pressure fuel discharge passage 4 at a branch portion 13, a delivery pipe 16 connected with the high-pressure fuel discharge passage 4, a plurality of fuel injection valves 17 connected with the delivery pipe 16, and a filter 18 connected with the low-pressure fuel pump 11.

FIG. 4 is a cross sectional view of the high-pressure fuel supply system 1 of FIG. 3.

The high-pressure fuel pump 5 of the high-pressure fuel supply system 1 includes a plate 21 having a fuel suction port 22 connected with the low-pressure fuel suction passage 2 and a fuel discharge port 23 connected with the high-pressure fuel discharge passage 4, a sleeve 24 of a cylindrical shape, a valve disc 25 having the suction valve 8 and arranged between an upper end face of the sleeve 24 and the plate 21, the discharge valve 9 arranged on the high-pressure fuel discharge passage 4, a piston 26 slidably received in the sleeve 24 to define a fuel pressurization chamber 27 in cooperation with the sleeve 24 for pressurizing the fuel that flows into the fuel pressurization chamber 27, and a spring 29 arranged under compression between a receiving portion 28 and a bracket 30 for urging the piston 26 in a direction to enlarge the volume of the fuel pressurization chamber 27.

In addition, the high-pressure fuel pump 5 includes a casing 31 having the low-pressure fuel suction passage 2 and the high-pressure fuel discharge passage 4, a housing 32 fixedly attached to the casing 31, and a tappet 33 slidably arranged at a tip end of the housing 32 and adapted to be placed into abutting engagement with a cam 35 fixedly secured to a camshaft 34 for causing the piston 26 to reciprocate in accordance with the profile of the cam 35.

FIG. 5 is an enlarged view of the electromagnetic valve 7 of FIG. 4. The electromagnetic valve 7 includes a plunger 40 having a fuel passage 40*a* formed therein along the axis thereof, a body 41 that is fitted in the casing 31 and a housing 44 and slidably receives the plunger 40, a valve seat 42 arranged in pressure contact with an end of the plunger 40 and welded to the body 41, a stopper 43 fixedly mounted on the housing 44 for limiting the amount of lift of the plunger 40 upon opening thereof, an armature 45 made of a magnetic material and welded to the plunger 40, a core 46 arranged in opposition to the armature 45, a solenoid 47 wound around the core 46, and a spring 48 arranged under compression inside the core 46 for urging the plunger 40 in a direction toward the valve seat 42.

Between the casing 31 and the housing 44 around the stopper 43, there is arranged an elastic O ring 49 for sealing fuel and absorbing collision sounds generated when the plunger 40 collides with the stopper 43. The housing 44 has a diametrally or radially extending protrusion 44*a* formed in the vicinity of the O ring 49 so as to prevent the O ring 49 from slipping off.

With the high-pressure fuel supply system 1 as constructed above, the piston 26 is caused to reciprocate through the intermediary of the tappet 33 in accordance with the rotation of the cam 35 fixedly attached to the camshaft 34 of the engine.

When the piston 26 descends (on the fuel suction stroke), the volume of the fuel pressurization chamber 27 increases to reduce the pressure therein. As a result, the suction valve 8 is opened so that the fuel in the low-pressure fuel supply passage 2 flows into the fuel pressurization chamber 27 through the fuel suction port 22.

When the piston 26 ascends (on the fuel discharge stroke), the pressure in the fuel pressurization chamber 27 increases to open the discharge valve 9 so that the fuel in the fuel pressurization chamber 27 is supplied to the delivery pipe 16 through the fuel discharge port 23 and the high-pressure fuel discharge passage 4. Thereafter, the fuel is supplied to the fuel injection valves 17 which serve to inject the fuel to respective cylinders (not shown) of the engine.

Moreover, when the solenoid 47 is energized, magnetic attraction is generated between the amateur 45 and the core 46 to cause the plunger 40 to move away from the valve seat 42 against the resilient force of the spring 48, thereby opening the electromagnetic valve 7. As a consequence, the relief passage 6 is placed in fluid communication with the fuel pressurization chamber 27 through the fuel passage 40*a* in the plunger 40 and the communication port 37 so that the pressure in the fuel pressurization chamber 27 is reduced to permit the discharge valve 9 to be closed, thereby stopping the supply of the high-pressure fuel to the fuel injection valve 17.

On the other hand, when the solenoid 47 is deenergized, the magnetic attraction between the armature 45 and the core 46 becomes zero so that the plunger 40 is placed in pressure contact with the valve seat 42 under the action of the resilient force of the spring 48, thereby closing the electromagnetic valve 7 and hence the relief passage 6.

FIG. 6 is a timing chart that shows the relation between the driving of the electromagnetic valve 7 and the suction and discharge strokes of the high-pressure fuel pump 5. In FIG. 6, an upper portion represents the amount of plunger lift; a black painted portion represents an area where fuel is discharged from the high-pressure fuel pump 5; and a lower portion represents the driving state of the electromagnetic valve 7. As can be seen from this figure, the amount of fuel discharged from the high-pressure fuel pump 5 on the fuel discharge stroke can be adjusted by controlling the driving timing of the electromagnetic valve 7.

With the high-pressure fuel supply system 1 of the above configuration, the amount of lift of the plunger 40 is limited by the collision of the plunger 40 with the stopper 43 when the electromagnetic valve 7 is opened, and a collision sound is generated at that time (see point A in FIGS. 5 and 6). Also, the plunger 40 collides with the valve seat 42 under the action of the resilient force of the spring 48 upon closure of the electromagnetic valve 7, and a collision sound is generated at that time (see point B in FIGS. 5 and 6).

Thus, collision sounds are generated upon opening and closing of the electromagnetic valve 7. In this connection, (a) in FIG. 7 represents, among the magnetic attraction acting between the armature 45 and the core 46, a basic load value required to ensure sealing under the pressure in the fuel pressurization chamber 27 upon opening of the electromagnetic valve 7, and (b) in FIG. 7 represents a portion of load beyond the basic load value, which acts on the electromagnetic valve 7 upon opening thereof.

On the other hand, upon closure of the electromagnetic valve 7, the resilient force of the spring 48 acts totally as a load on the closing of the electromagnetic valve 7, so that the plunger 40 is caused to collide with the valve seat 42 by the full resilient force of the spring 48. Therefore, the collision sound is larger upon closure of the electromagnetic valve 7 than upon opening thereof, and particularly at high pressure (for instance, 15 MPa) in the fuel pressurization chamber 27, the spring 48 with a great resilient force is required and hence the collision sound generated at that time becomes so large.

Thus, there arises a problem that the large collision sound generated is directly transmitted to the delivery pipe 16 through high-pressure piping connected with the high-pressure fuel pump 5, resulting in the generation of large noise due to resonance in the course of the sound transmission.

SUMMARY OF THE INVENTION

The present invention is intended to obviate the problem referred to above, and has for its object to provide a high-pressure fuel supply system which is capable of reducing the generation of noise upon opening and closing of an electromagnetic valve.

Bearing the above object in mind, according to one aspect of the present invention, there is provided a high-pressure fuel supply system including: a low-pressure fuel suction passage connected with a fuel tank: a high-pressure fuel discharge passage connected with a delivery pipe which is in turn connected with a fuel injection valve; a fuel pump arranged between the low-pressure fuel suction passage and the high-pressure fuel discharge passage and being operable, during reciprocation of a piston in a sleeve, to open a suction valve to suck fuel from the low-pressure fuel suction passage into a fuel pressurization chamber on a suction stroke and to open a discharge valve to discharge the fuel in the fuel pressurization chamber to the high-pressure fuel discharge passage on a discharge stroke; a relief passage connecting between the fuel pump and the low-pressure fuel suction passage; and an electromagnetic valve arranged on the relief passage and adapted to be opened to control an amount of fuel discharged from the fuel pump on a discharge stroke. The electromagnetic valve includes; a body; a plunger slidably received in the body; a valve seat with which the plunger is caused to move into and out of contact so that the valve seat is placed into fluid communication with the fuel pressurization chamber when the plunger is moved apart from the valve seat; a stopper for limiting the distance of separation of the plunger from the valve seat; and a spring for urging the plunger in a direction toward or away from the valve seat. An elastic O ring is provided around the valve seat for absorbing collision sounds generated when the plunger collides with the valve seat. With this arrangement, noise such as collision sounds generated upon closure of the electromagnetic valve can be effectively reduced.

According to another aspect of the present invention, there is provided a high-pressure fuel supply system including: a low-pressure fuel suction passage connected with a fuel tank; a high-pressure fuel discharge passage connected with a delivery pipe which is in turn connected with a fuel injection valve; a fuel pump arranged between the low-pressure fuel suction passage and the high-pressure fuel discharge passage and being operable, during reciprocation of a piston in a sleeve, to open a suction valve to suck fuel from the low-pressure fuel suction passage into a fuel pressurization chamber on a suction stroke and to open a discharge valve to discharge the fuel in the fuel pressurization chamber to the high-pressure fuel discharge passage on a discharge stroke; a relief passage connecting between the fuel pump and the low-pressure fuel suction passage; and an electromagnetic valve arranged on the relief passage and adapted to be opened to control an amount of fuel discharged from the fuel pump on a discharge stroke. The electromagnetic valve includes; a body; a plunger slidably received in the body; a valve seat with which the plunger is caused to move into and out of contact so that the valve seat is placed into fluid communication with the fuel pressurization chamber when the plunger is moved apart from the valve seat; a stopper for limiting the distance of separation of the plunger from the valve seat; a spring for urging the plunger in a direction toward or away from the valve seat; and a first elastic O ring provided on a housing around the stopper for absorbing collision sounds generated when the plunger collides with the valve seat. A first nonmetallic ring for ensuring a clearance between a radially extending protrusion of the housing, which serves to prevent the first O ring from slipping off, and a casing enclosing the housing is provided in the vicinity of the first O ring sandwiched between the housing and the casing. With this arrangement, the path through which vibrations accompanying the collision of the plunger with the valve seat upon opening of the electromagnetic valve are transmitted to the casing through the protrusion of the housing is cut off or interrupted, thereby reducing noise resulting form the vibrations.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENT

Hereinafter, preferred embodiments of the present invention will be described in detail while referring to the accompanying drawings, with the same or corresponding parts or members thereof as the above-mentioned known ones being identified by the same symbols.

Embodiment 1

Figure 1:
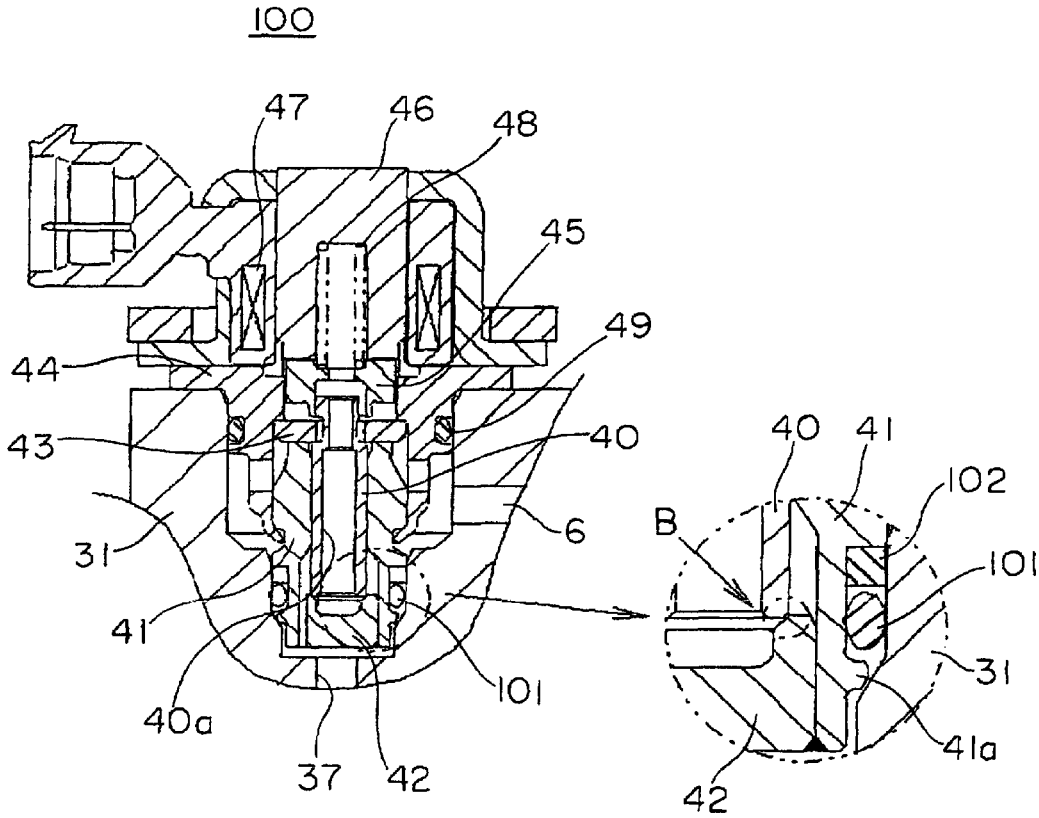
FIG. 1 is a cross sectional view of an electromagnetic valve of a high-pressure fuel supply system according to a first embodiment of the present invention.

FIG. 1 is a cross sectional view of an electromagnetic valve 100 of a high-pressure fuel supply system according to a first embodiment of the present invention.

The electromagnetic valve 100 includes a plunger 40 having a fuel passage 40*a* formed therein along the axis thereof, a body 41 that is fitted in the casing 31 and a housing 44 and slidably receives the plunger 40, a valve seat 42 arranged in pressure contact with an end of the plunger 40 and welded to the body 41, a stopper 43 fixedly mounted on the housing 44 for limiting the amount of lift of the plunger 40 upon opening thereof, an armature 45 made of a magnetic material and welded to the plunger 40, a core 46 arranged in opposition to the armature 45, a solenoid 47 wound around the core 46, and a spring 48 arranged under compression inside the core 46 for urging the plunger 40 in a direction toward the valve seat 42.

Between the casing 31 and the housing 44 around the stopper 43, there is arranged an elastic O ring 49 for sealing fuel and absorbing collision sounds generated when the plunger 40 collides with the stopper 43.

In addition, an elastic O ring 101 is provided around the valve seat 42 for absorbing collision sounds generated when the plunger 40 collides with the valve seat 42. The O ring 101 is arranged between the body 41 and the casing 31 enclosing the body 41. Moreover, a nonmetallic ring 102 is arranged in the vicinity of the O ring 41 for preventing the diametrally or radially extending protrusion 41*a* of the body 41, which serves to prevent the O ring 41 from slipping off, and the casing 31 from coming in contact with each other. The nonmetallic ring 102 is made of a material with high rigidity such as a Teflon (registered trademark for polytetrafluoroethylene) based resin, for example, for ensuring a clearance or gap between the protrusion 41*a* and the casing 31.

With the electromagnetic valve 100 of this high-pressure fuel supply system, upon opening thereof, the plunger 40 is lifted to collide with the stopper 43, thus generating a collision sound. Also, upon closure of the electromagnetic valve 100, the plunger 40 collides with the valve seat 42 under the action of the resilient force of the spring 48, whereupon a collision sound is generated, too.

Thus, collision sounds are generated when the electromagnetic valve 100 is opened and closed, respectively, the collision sound generated upon opening thereof is mainly absorbed by the O ring 49 around the stopper 43, so that the noise transmitted to the delivery pipe 16 through the high-pressure piping is reduced. On the other hand, upon closure of the electromagnetic valve 7, the resilient force of the spring 48 acts entirely as a load on the opening of the electromagnetic valve 7, causing the plunger 40 to collide with the valve seat 42 while generating a collision sound. Therefore, the collision sound generated at this time is greater than the one generated upon opening of the electromagnetic valve 100, but a major part of the collision sound is absorbed by the O ring 101 arranged around the valve seat 42.

Furthermore, since contact between the protrusion 41*a* of the body 41 and the casing 31 is prevented by the nonmetallic ring 102, so that the transmission of vibrations generated upon collision to the casing 31 through the projected portion or protrusion 41*a* of the body 41 can be prevented, thereby making it possible to reduce the generation of noise resulting from the vibrations.

Embodiment 2

Figure 2:
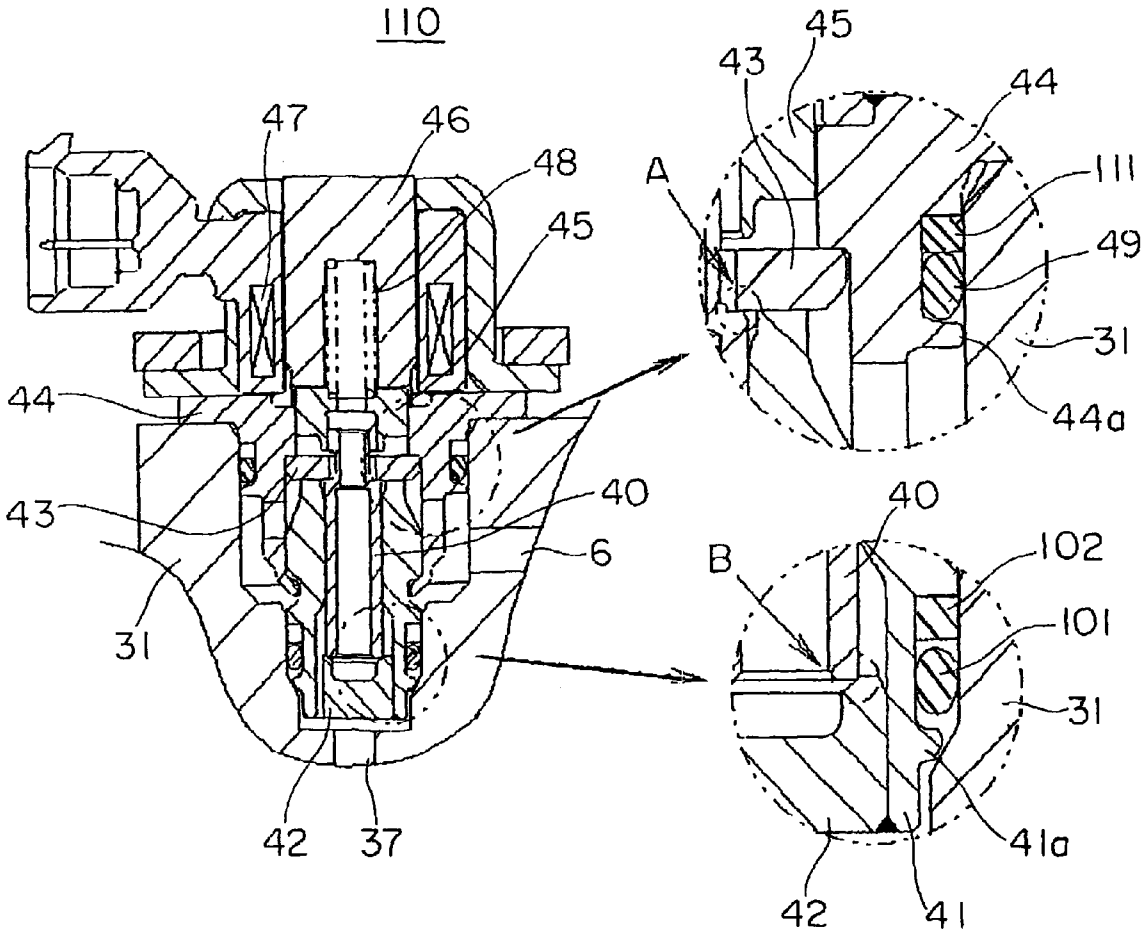
FIG. 2 is a cross sectional view of an electromagnetic valve of a high-pressure fuel supply system according to a second embodiment of the present invention.
Figure 3:
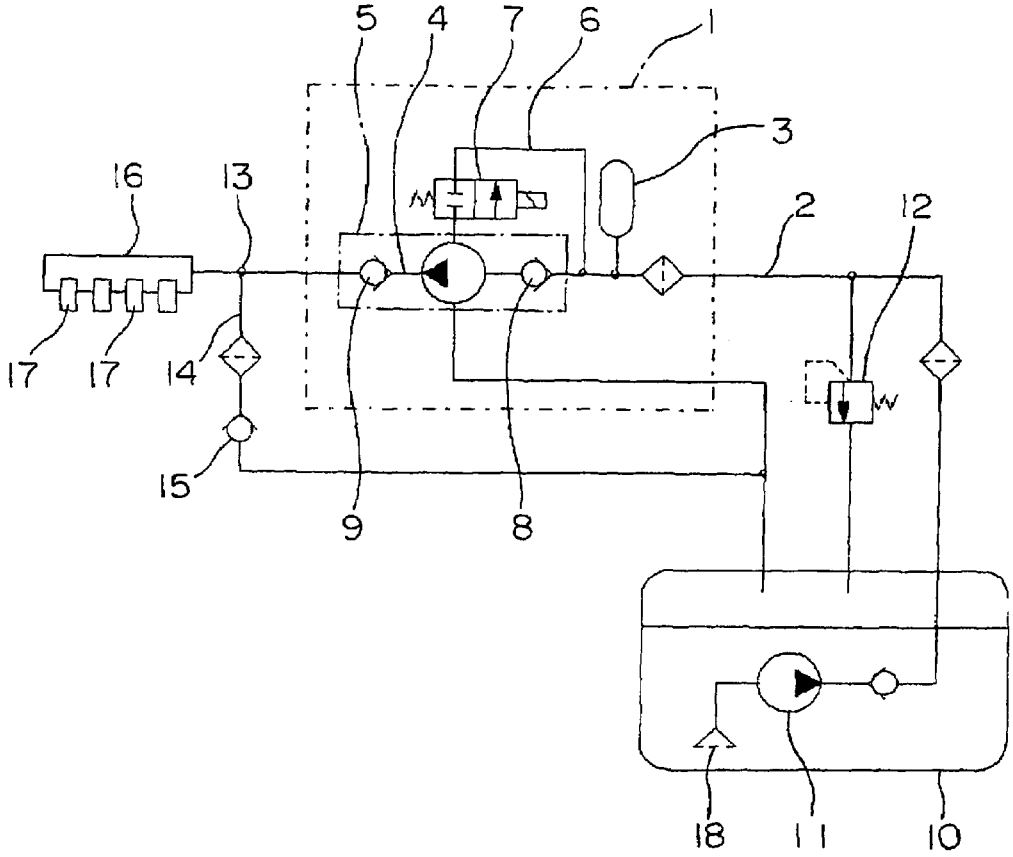
FIG. 3 is a circuit diagram of a known high-pressure fuel supply system.
Figure 4:
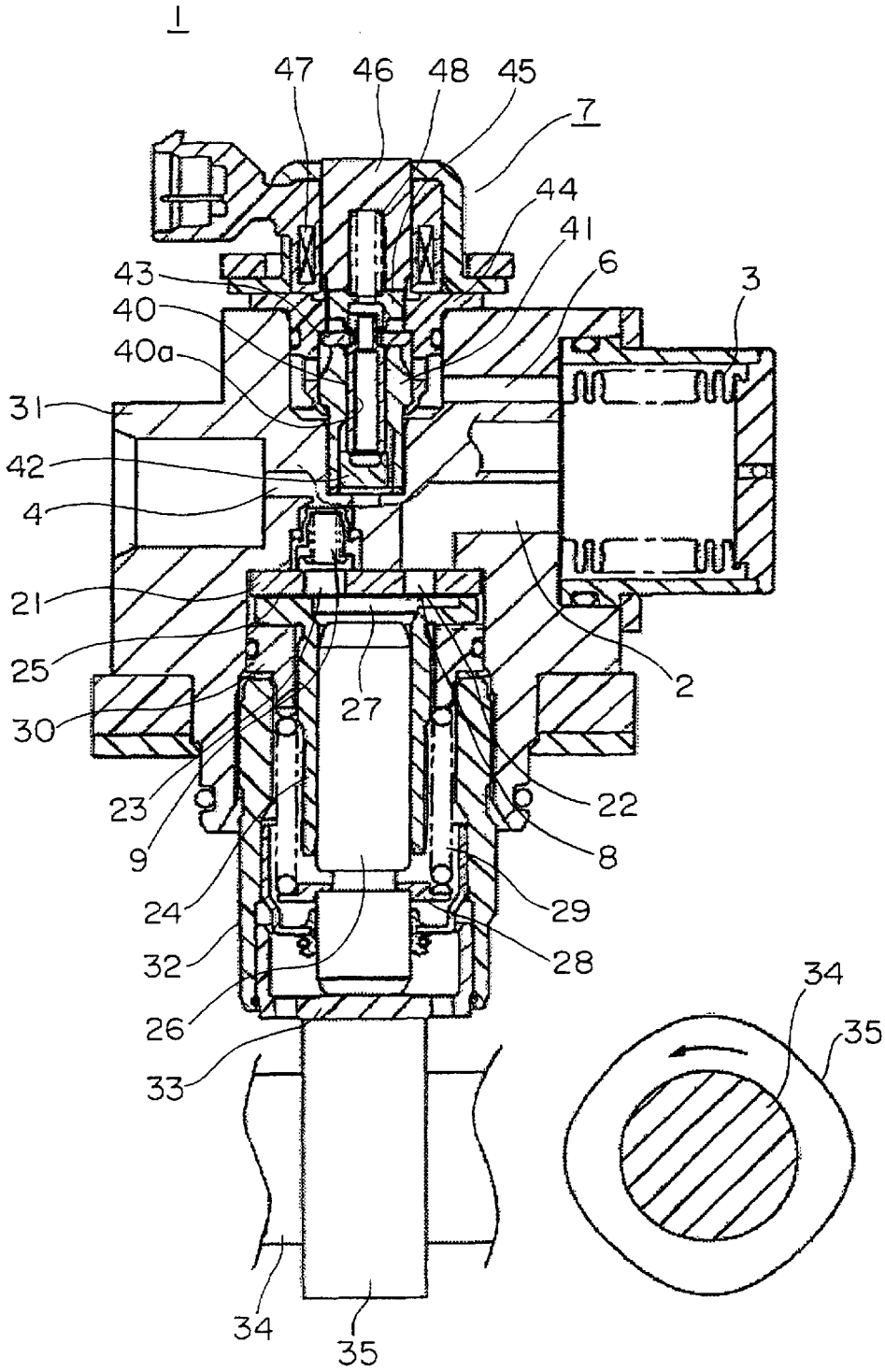
FIG. 4 is a cross sectional view of the high-pressure fuel supply system of FIG. 3.
Figure 5:
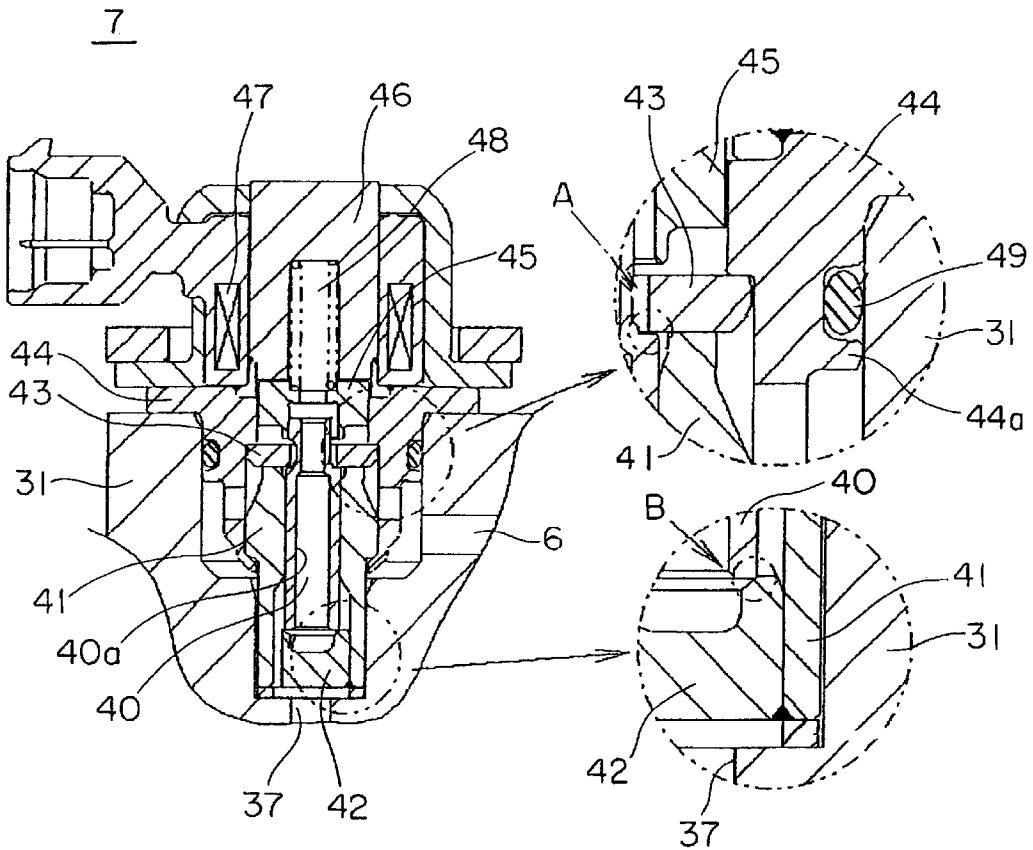
FIG. 5 is a cross sectional view of an electromagnetic valve shown in FIG. 4.
Figure 6:
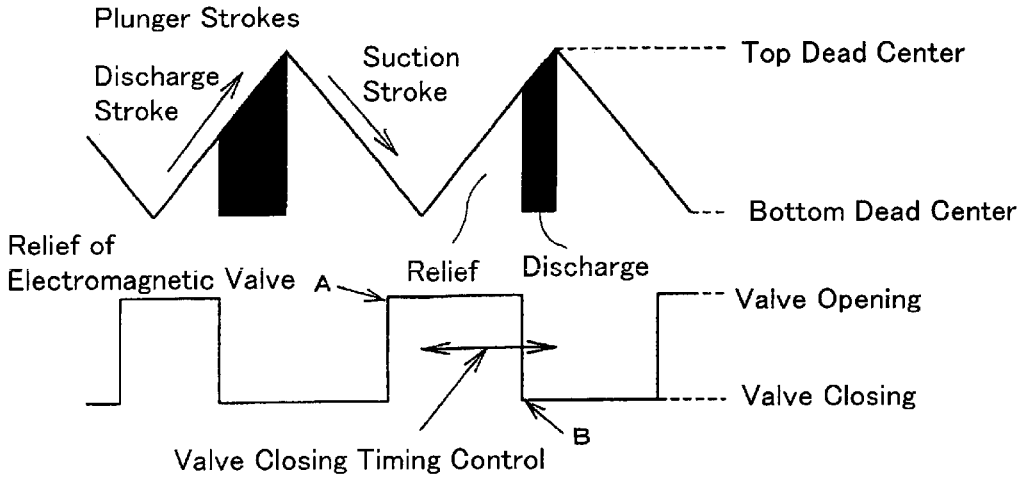
FIG. 6 is a timing chart showing the relation between the driving of the electromagnetic valve and the suction and discharge strokes of a high-pressure fuel pump of the known high-pressure fuel supply system of FIG. 4.
Figure 7:
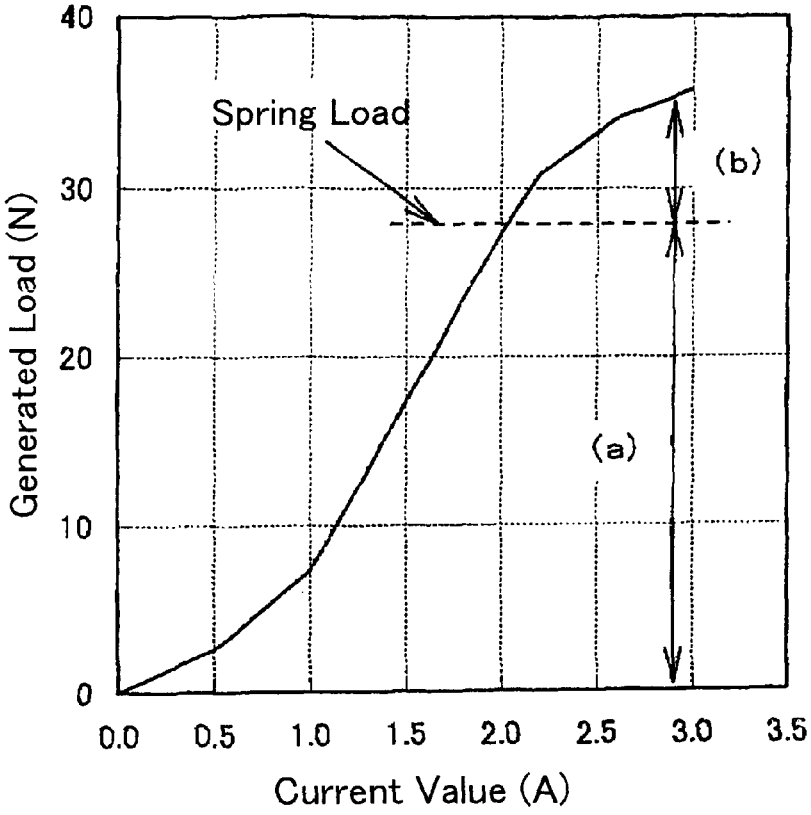
FIG. 7 is a view showing the relation between the value of current supplied to the electromagnetic valve of FIG. 4 and the load generated.

FIG. 2 is a cross sectional view of an electromagnetic valve 110 of a high-pressure fuel supply system according to a second embodiment of the present invention. In this electromagnetic valve 110, in the vicinity of the O ring 49 sandwiched between the housing 44 and the casing 31 there is provided a nonmetallic ring 111 for preventing a protrusion 44*a* of the housing 44 and the casing 31 from coming in contact with each other. The nonmetallic ring 111 is made of a material with high rigidity such as, for example, a Teflon (registered trademark) based resin, and serves to ensure a clearance or gap between the protrusion 44*a* and the casing 31.

The construction of this embodiment other than the above is similar to that of the first embodiment.

In this second embodiment, the transmission of vibrations, which are generated when the plunger 40 collides with the valve seat 42, to the casing 31 through the projected portion or protrusion 41*a* of the body 41 is prevented by the nonmetallic ring 102, as in the first embodiment, and at the same time, contact between the protrusion 44*a* of the housing 44 and the casing 31 is prevented by the nonmetallic ring 111. Accordingly, vibrations generated upon collision can also be prevented from being transmitted from the housing 44 to the casing 31 through the protrusion 44*a* of the housing 44, thus making it possible to further reduce the generation of sound or noise resulting from the vibrations.

In addition, with the electromagnetic valve 100 or 110 of the first or second embodiment, the plunger 40 is urged into pressure contact with the valve seat 42 by the resilient force of the spring 48 when the electromagnetic valve 100 is closed, whereas the armature 45 is magnetically attracted or drawn to the core 46 by energizing the solenoid 47 when the electromagnetic valve 100 is opened. However, the present invention is of course applicable to such an electromagnetic valve in which upon opening of the electromagnetic valve, an end of the plunger is urged to separate from the valve seat in a direction away from the spring under the action of the resilient force thereof, whereas upon closure of the electromagnetic valve, the armature is magnetically attracted or drawn from the core by energizing the solenoid so that the end of the plunger is forced to collide with the valve seat.

Moreover, with the electromagnetic valve 100 or 110 of the above-mentioned first or second embodiment, the O ring 49 is received in the groove in the housing 44 and the O ring 101 is received in the groove in the body 41, but they may instead be respectively received in grooves formed in the casing 31.

As described in the foregoing, an electromagnetic valve in a high-pressure fuel supply system according to one aspect of the present invention includes; a body; a plunger slidably received in the body; a valve seat with which the plunger is caused to move into and out of contact so that the valve seat is placed into fluid communication with a fuel pressurization chamber when the plunger is moved apart from the valve seat; a stopper for limiting the distance of separation of the plunger from the valve seat; and a spring for urging the plunger in a direction toward or away from the valve seat. An elastic O ring is provided around the valve seat for absorbing collision sounds generated when the plunger collides with the valve seat. With this arrangement, it is possible to effectively reduce noise such as collision sounds generated upon closure of the electromagnetic valve.

Preferably, the O ring is arranged between the body and a casing enclosing the body, and a nonmetallic ring is provided in the vicinity of the O ring for ensuring a clearance between a radially extending protrusion of the body, which serves to prevent the O ring from slipping off, and the casing. Thus, the path through which vibrations accompanying the collision of the plunger with the valve seat upon closure of the electromagnetic valve are transmitted to the casing through the protrusion of the body is cut off or interrupted so that noise resulting form the vibrations can be effectively reduced.

An electromagnetic valve in a high-pressure fuel supply system according to another aspect of the present invention includes; a body; a plunger slidably received in the body; a valve seat with which the plunger is caused to move into and out of contact so that the valve seat is placed into fluid communication with the fuel pressurization chamber when the plunger is moved apart from the valve seat; a stopper for limiting the distance of separation of the plunger from the valve seat; a spring for urging the plunger in a direction toward or away from the valve seat; and a first elastic O ring provided on a housing around the stopper for absorbing collision sounds generated when the plunger collides with the valve seat. A first nonmetallic ring for ensuring a clearance between a radially extending protrusion of the housing, which serves to prevent the first O ring from slipping off, and a casing enclosing the housing is provided in the vicinity of the first O ring sandwiched between the housing and the casing. With this arrangement, the path through which vibrations accompanying the collision of the plunger with the valve seat upon opening of the electromagnetic valve are transmitted to the casing through the protrusion of the housing is cut off or interrupted, thereby reducing noise resulting form the vibrations.

Preferably, a second elastic O ring is provided around the valve seat for absorbing collision sounds generated when the plunger collides with the valve seat. Thus, noise such as collision sounds generated upon closure and opening of the electromagnetic valve can be effectively reduced.

Preferably, the second O ring is arranged between the body and the casing enclosing the body, and a second nonmetallic ring is provided in the vicinity of the second O ring for ensuring a clearance between a radially extending protrusion of the body, which serves to prevent the second O ring from slipping off, and the casing. Thus, the path through which vibrations accompanying the collision of the plunger with the valve seat upon closure of the electromagnetic valve are transmitted to the casing through the protrusion of the body is cut off or interrupted so that noise resulting form the vibrations can be effectively reduced.

While the invention has been described in terms of preferred embodiments, those skilled in the art will recognize that the invention can be practiced with modifications within the spirit and scope of the appended claims.

What is claimed is:

1. A high-pressure fuel supply system comprising:

a low-pressure fuel suction passage connected with a fuel tank;

a high-pressure fuel discharge passage connected with a delivery pipe which is in turn connected with a fuel injection valve;

a fuel pump arranged between said low-pressure fuel suction passage and said high-pressure fuel discharge passage and being operable, during reciprocation of a piston in a sleeve, to open a suction valve to suck fuel from said low-pressure fuel suction passage into a fuel pressurization chamber on a suction stroke and to open a discharge valve to discharge the fuel in said fuel pressurization chamber to said high-pressure fuel discharge passage on a discharge stroke;

a relief passage connecting between said fuel pump and said low-pressure fuel suction passage; and an electromagnetic valve arranged on said relief passage and adapted to be opened to control an amount of fuel discharged from said fuel pump on a discharge stroke;

said electromagnetic valve comprising:

a body;

a plunger slidably received in said body;

a valve seat with which said plunger is caused to move into and out of contact so that said valve seat is placed into fluid communication with said fuel pressurization chamber when said plunger is moved apart from said valve seat;

a stopper for limiting the distance of separation of said plunger from said valve seat; and a spring for urging said plunger in a direction toward or away from said valve seat;

wherein an elastic O ring is provided around said valve seat for absorbing collision sounds generated when said plunger collides with said valve seat, wherein a casing encloses said body, and wherein a nonmetallic ring is provided in the vicinity of said O ring for ensuring a clearance between a radially extending protrusion of said body, which serves to prevent said O ring from slipping off, and said casing.

2. The high-pressure fuel supply system according to claim 1, wherein said O ring is arranged between said body and said casing.

3. A high-pressure fuel supply system comprising:

a low-pressure fuel suction passage connected with a fuel tank;

a high-pressure fuel discharge passage connected with a delivery pipe which is in turn connected with a fuel injection valve;

a fuel pump arranged between said low-pressure fuel suction passage and said high-pressure fuel discharge passage and being operable, during reciprocation of a piston in a sleeve, to open a suction valve to suck fuel from said low-pressure fuel suction passage into a fuel pressurization chamber on a suction stroke and to open a discharge valve to discharge the fuel in said fuel pressurization chamber to said high-pressure fuel discharge passage on a discharge stroke;

a relief passage connecting between said fuel pump and said low-pressure fuel suction passage; and an electromagnetic valve arranged on said relief passage and adapted to be opened to control an amount of fuel discharged from said fuel pump on a discharge stroke;

said electromagnetic valve comprising:

a body;

a plunger slidably received in said body;

a valve seat with which said plunger is caused to move into and out of contact so that said valve seat is placed into fluid communication with said fuel pressurization chamber when said plunger is moved apart from said valve seat;

a stopper for limiting the distance of separation of said plunger from said valve seat;

a spring for urging said plunger in a direction toward or away from said valve seat; and a first elastic O ring provided on a housing around said stopper for absorbing collision sounds generated when said plunger collides with said valve seat;

wherein a first nonmetallic ring for ensuring a clearance between a radially extending protrusion of said housing, which serves to prevent said first O ring from slipping off, and a casing enclosing said housing is provided in the vicinity of said first O ring sandwiched between said housing and said casing.

4. The high-pressure fuel supply system according to claim 3, wherein a second elastic O ring is provided around said valve seat for absorbing collision sounds generated when said plunger collides with said valve seat.

5. The high-pressure fuel supply system according to claim 4, wherein said second O ring is arranged between said body and said casing enclosing said body, and a second nonmetallic ring is provided in the vicinity of said second O ring for ensuring a clearance between a radially extending protrusion of said body, which serves to prevent said second O ring from slipping off, and said casing.

* * * * *